US007494448B2

(12) United States Patent
Eschenbach

(10) Patent No.: US 7,494,448 B2
(45) Date of Patent: Feb. 24, 2009

(54) RECUMBENT ELLIPTICAL EXERCISE APPARATUS

(76) Inventor: Paul William Eschenbach, 290 South Tyger La., Roebuck, SC (US) 29376

( * ) Notice: Subject to any disclaimer, the term of this patent is extended or adjusted under 35 U.S.C. 154(b) by 612 days.

(21) Appl. No.: 11/263,226

(22) Filed: Nov. 1, 2005

(65) Prior Publication Data

US 2007/0099764 A1 May 3, 2007

(51) Int. Cl.
*A63B 22/00* (2006.01)
*A63B 22/06* (2006.01)

(52) U.S. Cl. ..... 482/52; 482/57; 482/51

(58) Field of Classification Search ..... 482/51–53, 482/57, 70, 79–80

See application file for complete search history.

(56) References Cited

U.S. PATENT DOCUMENTS

| | | | | |
|---|---|---|---|---|
| 5,106,081 | A | 4/1992 | Webb | 482/137 |
| 5,356,356 | A | 10/1994 | Hildebrandt | 482/62 |
| 5,514,053 | A | 5/1996 | Hawkins | 482/63 |
| 5,611,758 | A * | 3/1997 | Rodgers, Jr. | 482/57 |
| 5,836,855 | A * | 11/1998 | Eschenbach | 482/57 |
| 5,916,065 | A * | 6/1999 | McBride et al. | 482/57 |
| 5,938,570 | A | 8/1999 | Maresh | 482/57 |
| 6,042,518 | A | 3/2000 | Hildebrant | 482/57 |
| 6,077,197 | A | 6/2000 | Stearns et al. | 482/52 |
| 6,168,552 | B1 * | 1/2001 | Eschenbach | 482/52 |
| 6,283,895 | B1 | 9/2001 | Stearns et al. | 482/52 |
| 6,409,635 | B1 | 6/2002 | Maresh | 482/57 |
| 6,666,799 | B2 | 12/2003 | Hildebrandt | 482/57 |
| 6,790,162 | B1 | 9/2004 | Ellis et al. | 482/51 |
| 6,932,745 | B1 | 8/2005 | Ellis | 482/52 |
| 2004/0259692 | A1 * | 12/2004 | Martin et al. | 482/52 |

* cited by examiner

*Primary Examiner*—Steve R Crow

(57) ABSTRACT

The present invention relates to a recumbent exercise apparatus that provides elliptical foot exercise with arm exercise. More particularly, the present invention relates to an exercise machine having separately supported pedals for the feet and arm exercise coordinated with the motion of the feet. The pedals articulate to provide lower leg exercise with the heel and toe remaining in contact with the pedal while the pedals move along an adjustable inclined elliptical pedal curve. Arm exercise is adjustable to accommodate different size operators. A separate foot contact is provided to overcome a startup toggle condition.

19 Claims, 3 Drawing Sheets

RECUMBENT ELLIPTICAL EXERCISE APPARATUS

FIELD

The present invention relates to a sit down exercise apparatus operated in a semi-recumbent position where foot operated pedals follow an oblong pedal path. More particularly, the present invention relates to an exercise machine having separately supported pedals for the feet and arm exercise coordinated with motion of the feet.

STATE OF THE ART

The benefits of regular exercise to improve overall health, appearance and longevity are well documented in the literature. For exercise enthusiasts, the search continues for safe apparatus that provides full body exercise for maximum benefit in minimum time. Furthermore, the aging population tends to favor semi-recumbent forms of exercise that encourage muscle tone.

The sit down exercise cycle is the most commonly used apparatus today to elevate the heart rate and exercise some of the leg muscles. To achieve any significant benefit, however, an extensive amount of time is demanded of the user resulting in boredom. To reduce the time needed to elevate the heart rate and exercise additional muscles, various forms of hand cranks and arm levers have been added to sit-down exercise cycles.

In recent years, semi-recumbent or more commonly referred to as recumbent exercise apparatus have appeared that provide for back and forth pedal movement to replace the traditional bike crank. Hawkins in U.S. Pat. No. 5,514,053 shows pedals that move back and forth along a linear path. Webb in U.S. Pat. No. 5,106,081 shows a leg exercise machine with pedals that move back and forth along an arc path. Hildebrandt et al. in U.S. Pat. No. 5,356,356 shows pedals that move back and forth along a circular path with arm exercise. Hildebrandt et al. in U.S. Pat. Nos. 6,042,518, 6,666,799 and Ellis et al. in U.S. Pat. No. 6,790,162 show back and forth pedal movement for a recumbent exerciser. Ellis in U.S. Pat. No. 6,932,745 also shows pedals that provide back and forth movement along a circular arc.

Another group of recumbent exercisers are emerging that use elliptical pedal movement for the feet. Rodgers, Jr. in U.S. Pat. No. 5,611,758 shows a recumbent exercise apparatus to generate an elliptical pedal movement using a crank, reciprocating member and roller/track to guide a pedal/foot member pivotally connected to the reciprocating member and a handle member. Eschenbach in U.S. Pat. No. 5,836,855, Maresh in U.S. Pat. Nos. 5,938,570 and 6,409,635 show elliptical foot motion for recumbent seated operation. Martin et al. in Pat. Application No. US 2004/0259692 shows pedal movements for a semi-recumbent exerciser. Stearns et al. in U.S. Pat. Nos. 6,077,197 and 6,283,895 show inclined pedals with elliptical movement for an operator leaning against a back support. McBride et al. in U.S. Pat. No. 5,916,065 shows elliptical pedal movement intended for stand-up operation in a seated position.

There is a need for a recumbent cycle that has an inclined elliptical pedal path configured to better utilize the range of leg and foot motion. There is also a need to adjust the incline angle of the ellipse to suit the desires of the operator. There is also a need to articulate the pedals to provide dorsi-flexion and plantar flexion foot exercise without raising the heel or toe from the pedal. There is a further need to coordinate arm exercise with the elliptical foot pedal path exercise for total body exercise that can be adjusted to accommodate the size of the operator.

SUMMARY OF THE INVENTION

The present invention relates to the kinematic motion control of pedals which provide extended leg exercise for semi-recumbent exercise. More particularly, apparatus is provided that offers variable intensity exercise through leg operated cyclic motion in which the pedal supporting each foot is guided through successive positions during the motion cycle while a load resistance acts upon the mechanism. Linkage is provided to coordinate arm exercise. A seat is provided adjustably supported by the framework to locate the operator in a generally semi-recumbent position.

The pedals are guided through an oblong or elongate curve motion during operation by a seated operator in a semi-recumbent position. The generally elliptical pedal curve is inclined towards the operator to maintain the leg force tangent to the curve during the down stroke to improve energy transfer from the leg muscles to the pedal motion control mechanism. The toe and heel of the operator remain in contact with the pedal while the pedal articulates for dorsi-flexion and plantar flexion exercise. The angle of the elliptical curve that is made with the horizontal surface is adjustable to provide a range of different pedal movements.

Arm exercise is by arm levers coordinated with the mechanism guiding the foot pedals. An adjustment mechanism is provided to move a handle pivot allowing the arm exercise to be closer or further away from the operator while maintaining the range of handle movement.

In the preferred embodiment, the apparatus includes a separate pedal for each foot, each pedal being inclined and rigidly attached to a foot support member which is pivotally connected to a rotary crank arm and pivotally connected to a guide. The location of the pedal upon the foot support member can be repositioned for a different pedal curve. The crank arm completes one full revolution during a pedal cycle and is phased generally opposite the crank arm for the other pedal through a bearing journal attached to the framework forming a crank pivot axis.

The guide for the preferred embodiment comprises a roller carriage having three rollers in contact with a two sided track. The roller carriage is pivotally connected to the foot support member at one end. An actuator, as directed by the control system, will raise or lower the rearward end of the track while the forward end of the track is pivotally attached to the framework.

Load resistance is provided by magnetic resistance internal to a flywheel which is adjusted by the control system. A pulley attached to a crank arm engages the flywheel by a belt. Other forms of load resistance such as belt friction, alternator, air fan, etc. may also be used.

Handles for arm exercise are pivotally attached to movable handle supports. Each handle is pivotally connected to a connector link which is also pivotally connected to the crank arm or foot support member. The handle support is pivotally connected to the framework at the crank pivot axis. An adjustment device allows the handles to be positioned close or further away from the operator without changing the range of handle movement.

The seat is movably attached to the framework and is adjustable by conventional means. Special foot contacts are provided on the foot support members to allow the operator to relocate the foot support member for a smooth startup without a toggle condition the can occur between the crank arm and foot support member when they align.

In a second embodiment, the guide is a rocker link pivotally connected to the forward end of the foot support member and pivotally connected to a screw nut. An actuator will move the screw nut to other positions as directed by the control system to change the angle of the rocker pivot path thus changing the angle of the pedal curve relative to a horizontal surface. Otherwise, the remainder of the second embodiment is the same as the preferred embodiment.

In summary, this invention provides the operator with coordinated semi-recumbent exercise of both the hands and feet through extended motions without joint impact. The angle of incline for the elliptical pedal curve is adjustable for a broader range of exercise. The handles for arm exercise can be repositioned closer or further away from the operator as desired. Should a toggle condition occur during startup, a special foot contact allows the operator to move the foot support for a non-toggle startup.

DETAILED DESCRIPTION OF THE EMBODIMENTS

Figure 1:
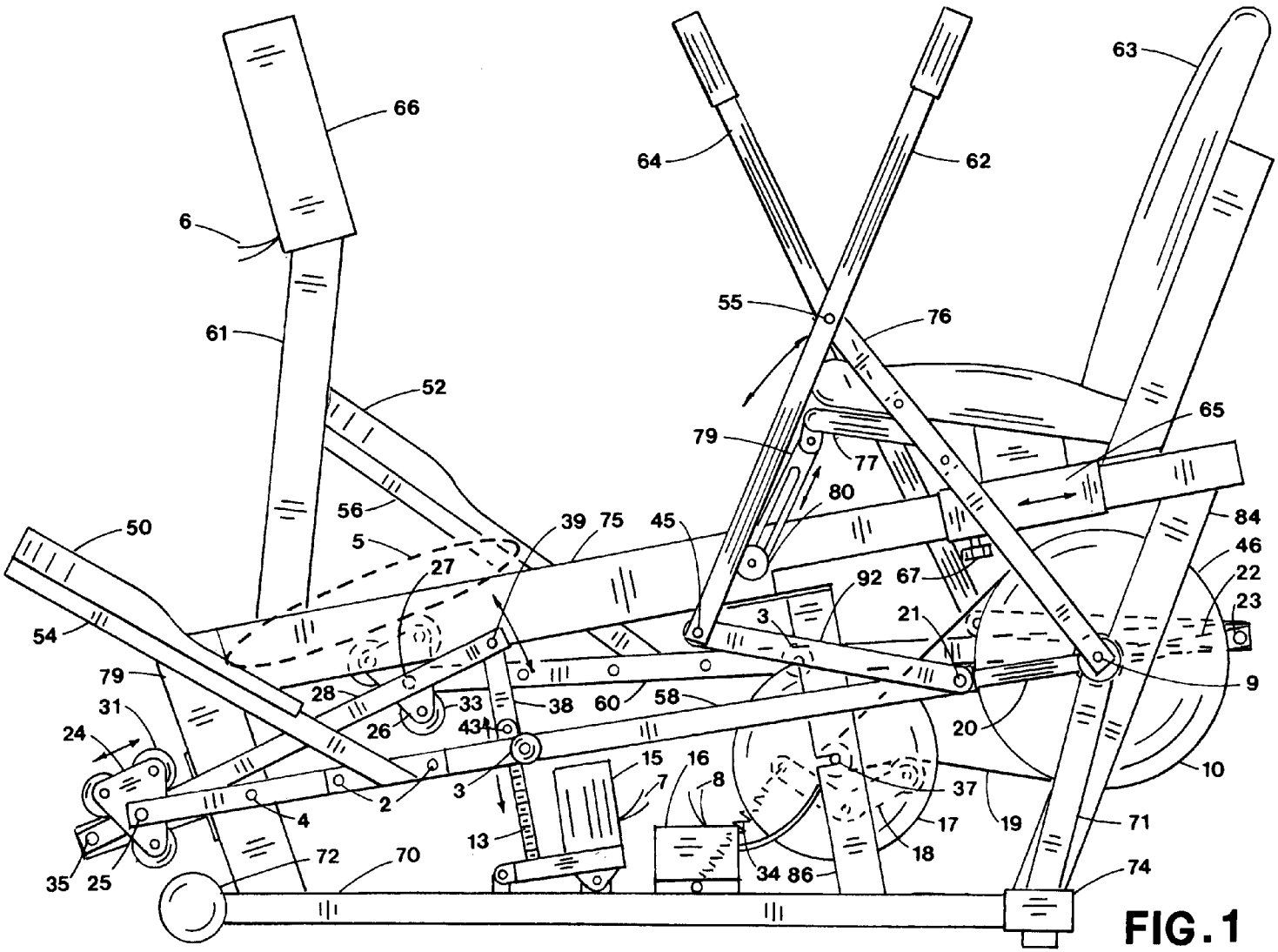
FIG. 1 is a left side elevation view of the preferred embodiment of an exercise machine constructed in accordance with the present invention.
Figure 2:
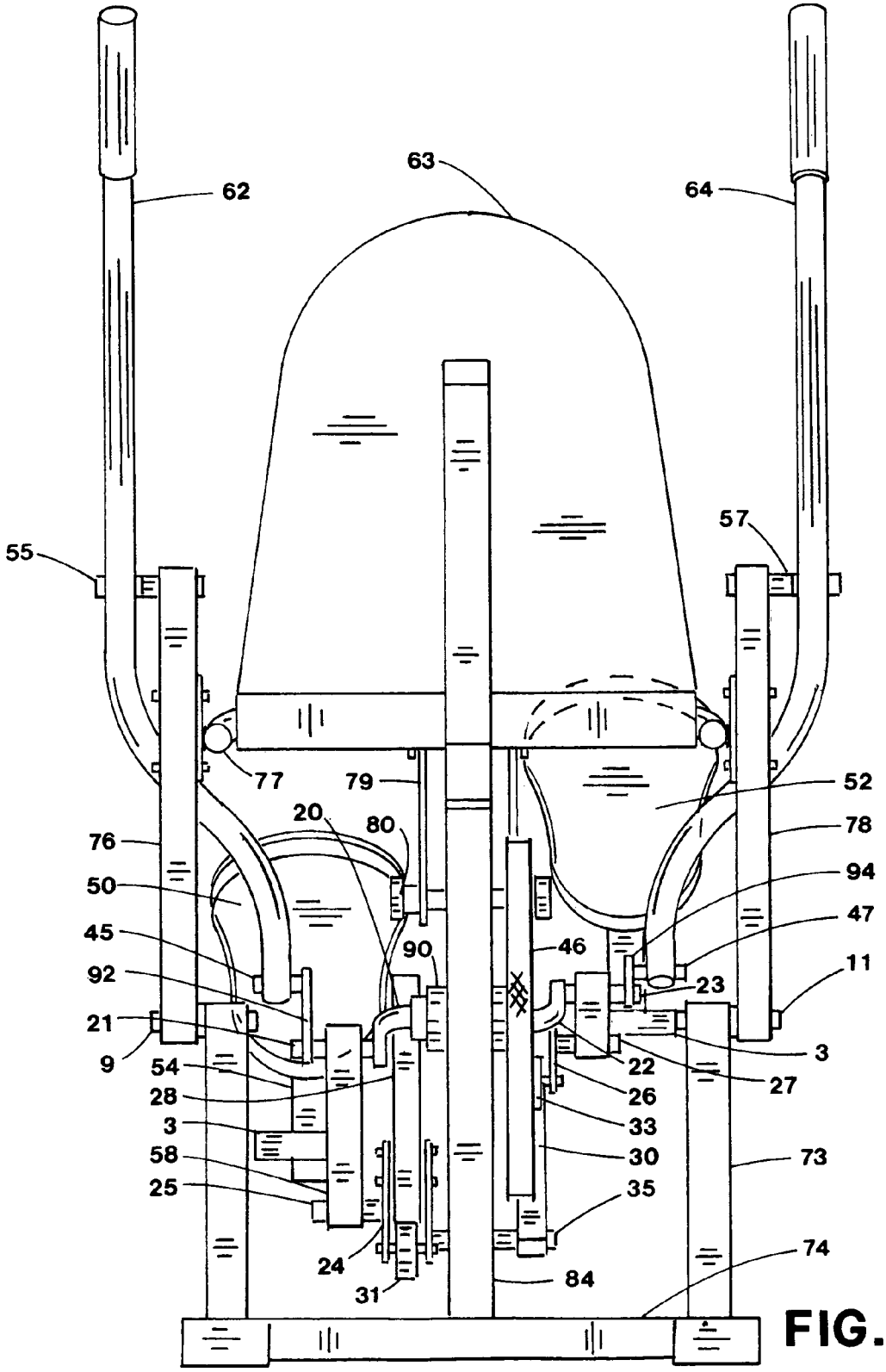
FIG. 2 is the rear view of the preferred embodiment shown in FIG. 1.

Referring to the drawings in detail, pedals 50,52 are shown in FIGS. 1 and 2 in their most forward and rearward positions of the preferred embodiment. During operation of the exercise apparatus, pedals 50,52 follow the inclined elliptical pedal curve 5. Foot support members 58,60 are connected to crank arms 20,22 at pivots 21,23 and to roller carriage 24,26 at pivots 25,27. Pedals 50,52 are attached to inclined support members 54,56 which are rigidly attached to foot support members 58,60 with connectors 2. Additional connectors 3,4 allow the pedals 50,52 to be repositioned along foot support members 58,60 to change the shape of pedal curve 5.

The forward ends of tracks 28,30 are connected to frame member 79 at pivot 35. The rearward ends of tracks 28,30 may be raised or lowered by actuator 15 which has screw nut 43 connected to screw 13. Links 38,40 are connected to screw nut 43 and to tracks 28,30 at pivots 39,41. Roller set 31,33 are pivotally connected to roller carriage 24,26 and are in rolling contact with tracks 28,30.

Crank arms 20,22 are connected generally opposed in crank bearing housing 90 forming a crank pivot axis. Crank bearing housing 90 is attached to frame member 84. Crank arms 20,22 and foot support members 58,60 are shown in toggle positions in FIG.1. An operator seated in seat 63 with feet positioned on pedals 50,52 could have difficulty overcoming the toggle position during startup. To avoid a difficult start, foot pegs 3 are attached to foot support members 58,60 whereby the operator initially places one foot on foot peg 3 to move crank arms 20,22 more vertical for better force transmission from the foot support member 58,60 to crank arms 20,22 once the feet are applying force upon pedals 50,52.

Pulley 46 is attached to crank arm 22 to rotate about the pivot axis. Flywheel 17 is connected to frame member 86 at pivot 37 and is engaged with pulley 46 by belt 19. Idler assembly 18 and spring 34 maintain belt tension. Once the pedals 50,52 are moving, the momentum of flywheel 17 supplies energy to drive through the toggle positions without notice by the operator.

During operation, pedals 50,52 articulate providing modest dorsi-flexion and plantar flexion foot rotation about the ankle similar to a standup cross trainer. Adjustment of the tracks 28,30 change the orientation of pedal curve 5 to exercise leg muscles differently. Control system 66 with wires 6 connected to wires 7 can regulate the actuator in a pre-programmed manner or manually by the operator. Flywheel 17 has magnetic resistance adjusted by controller 16 with wires 8 connected to the wires 6 of control system 66 using conventional means. Control system 66 is attached to support 61 which is connected to frame member 75.

Frame members 72,74 are configured to rest on a horizontal surface and are connected by frame member 70. Frame members 75,79,84,86 and 70 are interconnected for the framework. Seat 63 is movably attached to frame member 75 by seat support 65. Knob 67 will secure seat support 65 to frame member 75 after operator adjustment for leg length.

Arm exercise is provided by handles 62,64 shown in FIGS. 1 and 2. Handles 62,64 are connected to handle supports 76,78 at pivots 55,57. Connector links 92,94 are connected to handles 62,64 at pivots 45,47 and crank arms 20,22 at pivots 21,23. Handle supports 76,78 are connected by crossover member 77 and configured to rotate about pivots 9,11 which coincide with the pivot axis on upright supports 71,73 which are attached to frame member 74. Slot arms 79 are pivotally connected to crossover member 77 and adjustment knob 80 on frame 75. When adjustment knob 80 is loosened, handle supports 76,78 rotate about pivots 9,11 allowing handle pivots 55,57 to be repositioned to move the handles 62,64 closer or further away from the operator. The range of movement for handles 62,64 remains the same for each position selected. Handle 62 is rearward when pedal 50 is forward.

Figure 3:
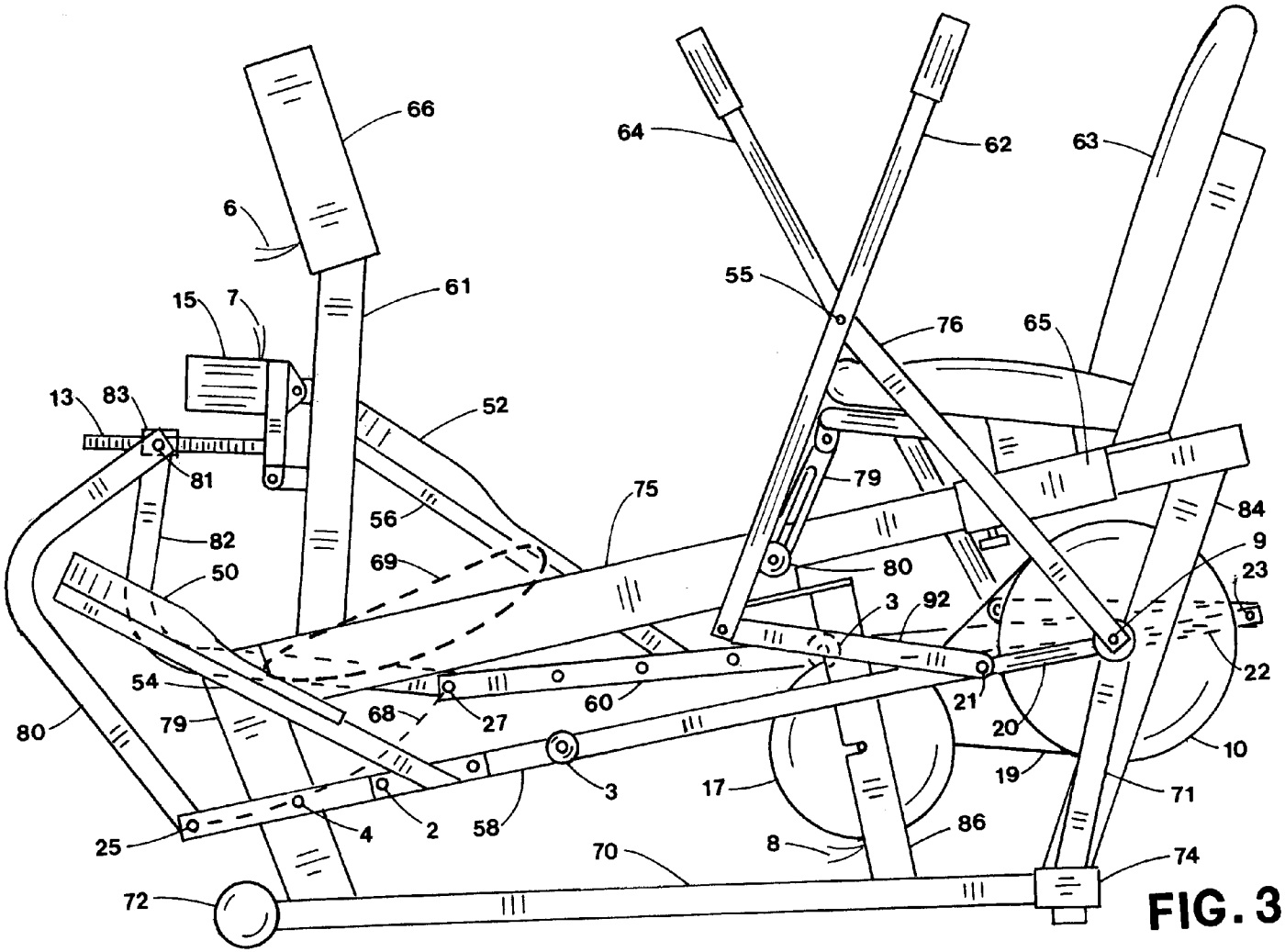
FIG. 3 is a left side elevation of the second embodiment of the present invention.

A second embodiment is shown in FIG. 3 where roller carriages 24,26 have been replaced as guides by rocker links 80,82. Rocker links 80,82 are connected to foot support members 58,60 at pivots 25,27 and to screw nut 83 at pivot 81. As crank arms 20,22 rotate, pedals 50,52 follow inclined pedal curve 69. Actuator 15 is connected to frame member 61 and with screw 13 connected to screw nut 83. When actuator 15 moves screw nut 83 along screw 13, the incline of curve 68 for pivots 25,27 changes with a resulting change of incline for pedal curve 69. Other features of the second embodiment are similar to the preferred embodiment.

The present invention may be embodied in other specific forms without departing from its spirit or essential characteristics. The described embodiments are to be considered in all respects only as illustrative, and not restrictive. The scope of the invention is, therefore, indicated by the claims, rather than by foregoing description. All changes which come within the meaning and range of equivalency of the claims are to be embraced within their scope.

What is claimed is:

1. An exercise apparatus comprising;

a framework, said framework, a seat attached to said framework configured to be supported by a horizontal surface and support a seated operator;

a pair of crank arms, said crank arms being connected generally opposed and configured to rotate about a pivot axis connected to said framework;

a pair of foot support members, each said foot support member having a first portion and a second portion, said first portion pivotally connected at one end to said crank arm, such that said second portion of said foot support member follows a generally inclined back and forth movement when said crank arm is rotated;

a pair of guides, each said guide having a track and rollers and being operably associated with said second portion of said foot support member;

a pair of pedals, each said pedal rigidly attached to said foot support member proximate said second portion of said foot support member and inclined relative thereto, wherein a user's feet directly contact the pedals during use;

said pedals configured to move relative to said framework when the foot of said seated operator is rotating said crank arms whereby said pedals follow an inclined elongate curve with the rear portion of said inclined elongate curve being higher than the front portion of said inclined elongate curve.

2. The exercise apparatus according to claim 1 wherein said inclined elongate curve is elliptical in shape.

3. The exercise apparatus according to claim 1 further comprising a pair of foot contacts, each said foot contact attached to a corresponding said foot support member to allow said operator to reposition said foot support member.

4. The exercise apparatus according to claim 1 further comprising a load resistance device, said load resistance device operably associated with said crank arms.

5. The exercise apparatus according to claim 4 wherein said load resistance device includes a control system having an adjustable resistance.

6. The exercise apparatus according to claim 1 wherein said guide comprises a rocker link, said rocker link pivotally connected to said foot support member and operably associated with said framework.

7. The exercise apparatus according to claim 1 further comprising an actuator, said actuator operably associated with said guide and said framework allowing the orientation of said elongate curve relative to the horizontal surface to be changed during operation of said exercise machine in conjunction with a control system.

8. The exercise apparatus according to claim 1 further comprising arm exercise, said arm exercise operably associated with said first portion of said foot support member.

9. The exercise apparatus according to claim 8 further comprising a pair of handles, each said handle pivotally connected to a handle support operably associated with said framework.

10. The exercise apparatus according to claim 9 further comprising a handle adjustment device, said handle adjustment device configured to allow said handles to be repositioned relative to said framework to accommodate said operator.

11. The exercise apparatus according to claim 1 further comprising a pair of pedal adjustment devices, each said pedal adjustment device allowing the reposition of said pedals relative to said foot support member to change the shape of said elongate curve.

12. The exercise apparatus according to claim 1 wherein the position of said seated operator is adjustable relative to said framework.

13. An exercise apparatus comprising;

a framework, said framework, a seat attached to said framework configured to be supported by a horizontal surface and support a seated operator for recumbent exercise;

a pair of crank arms, said crank arms being connected generally opposed and configured to rotate about a pivot axis connected to said framework the rearward portion of said exercise apparatus;

a pair of foot support members, each said foot support member having a first portion and a second portion, said first portion pivotally connected to one end to with said crank arm;

a pair of guides, each said guide having a track and rollers and being operably associated with said second portion of said foot support member to cause said second portion of said foot support member to have back and forth inclined movement;

a pair of pedals, each said pedal rigidly attached to said foot support member proximate said second portion of said foot support member and inclined relative thereto, wherein a user's feet directly contact the pedals during use;

said pedals configured to move relative to said framework when the foot of said seated operator is rotating said crank arms whereby said pedals follow an inclined elongate curve such that said pedals articulate to provide exercise for the lower leg.

14. The exercise apparatus according to claim 13 further comprising a pair of foot contacts, each said foot contact attached to a corresponding said foot support member to allow said operator to reposition said foot support member.

15. The exercise apparatus according to claim 13 further comprising an actuator, said actuator operably associated with said guide and said framework allowing the orientation of said elongate curve relative to the horizontal surface to be changed during operation of said exercise machine in conjunction with a control system.

16. The exercise apparatus according to claim 13 further comprising a pair of handles for arm exercise, said handles being movable by a handle adjustment device, said handle adjustment device configured to allow said handles to be repositioned relative to said framework to achieve handle locations that accommodate said operator.

17. An exercise apparatus comprising;

a framework, said framework, a seat attached to said framework configured to be supported by a horizontal surface and support a seated operator;

a pair of crank arms, said crank arms being connected generally opposed and configured to rotate about a pivot axis connected to said framework;

a pair of foot support members, each said foot support member having a first portion and a second portion, said first portion pivotally connected at one end to said crank arm, such that said second portion of said foot support member follows a generally back and forth movement when said crank arm is rotated;

a pair of guides, each said guide having a track and rollers and being operably associated with said second portion of said foot support member;

a pair of pedals, each said pedal connected to said foot support member proximate said second portion of said foot support member and inclined relative thereto, wherein a user's feet directly contact the pedals during use;

a pair of handles for arm exercise, each handle pivotally connected to a handle support;

a pair of connector links, each connector link pivotally connected to a corresponding handle and crank arm;

said pedals configured to move relative to said framework when the foot of said seated operator is rotating said crank arms whereby said pedals follow an elongate curve.

18. The exercise apparatus according to claim 17 further comprising a handle adjustment device, said handle adjustment device configured to reposition said handle supports to relocate the handles to accommodate said seated operator.

19. The exercise apparatus according to claim 17 further comprising an actuator, said actuator operably associated with said guide and said framework allowing the orientation of said elongate curve relative to the horizontal surface to be changed during operation of said exercise machine.

* * * * *